United States Patent [19]

Pettitt

[11] 4,053,543

[45] Oct. 11, 1977

[54] AIR BLEED CONTROL FOR CARBURETOR IDLE SYSTEM

[75] Inventor: James H. Pettitt, Woodhaven, Mich.

[73] Assignee: ACF Industries, Inc., New York, N.Y.

[21] Appl. No.: 627,661

[22] Filed: Oct. 31, 1975

[51] Int. Cl.[2] ..... F02M 3/04

[52] U.S. Cl. ..... 261/121 B; 123/97 B; 261/DIG. 19; 137/DIG. 8

[58] Field of Search ..... 261/121 B, DIG. 18, 261/DIG. 19; 123/97 B; 137/DIG. 8

[56] References Cited

U.S. PATENT DOCUMENTS

| | | | |
|---|---|---|---|
| 3,795,237 | 3/1974 | Denton | 123/97 B |
| 3,866,588 | 2/1975 | Nakada et al. | 123/97 B |
| 3,921,612 | 11/1975 | Aono | 261/121 B |
| 3,955,364 | 5/1976 | Lewis | 123/97 B |

*Primary Examiner*—Tim R. Miles

[57] ABSTRACT

A carburetor for an internal combustion engine has an idle or low speed system in which air is bled into the idle fuel passage. An air bleed valve member controls the amount of air flow through an air bleed port for the idle fuel passage and a diaphragm operated control is connected to the air bleed valve member to control the movement of the valve member. The diaphragm operated control has an air chamber on one side of the diaphragm and a vacuum chamber on the other side of the diaphragm with a restricted opening between the air and vacuum chambers. Upon a rapid engine deceleration to an idle position, the air bleed valve member is moved to a position to provide maximum air flow to the idle fuel passage for a limited period of time until the pressure is equalized between the vacuum chamber and the air chamber through the restricted opening. Such an arrangement permits fuel which has previously condensed on the walls of the manifold to be leaned for a short period of time after a rapid increase in intake manifold vacuum which results from rapid engine deceleration to an idle position.

3 Claims, 6 Drawing Figures

58
78

56
44
42
46
54
45
40
36
12
10
50

58

74
69
98
62
72
84
82
72
70
81
68
76
64
60
88
78
66
86
80
56
90
45
40
54
50

58

69
62
74
98
72
82
84
64
70
68
81
76
60
88
78
86
80
56
90
45
40
54
50

AIR BLEED CONTROL FOR CARBURETOR IDLE SYSTEM

BACKGROUND OF THE INVENTION

During normal driving, including some acceleration, fuel is supplied along with air to the manifold of the engine. At all such times, some of the fuel wets the walls of the intake manifold and a quantity of fuel is usually present in a liquid form. This condition exists even though the pressure in the manifold is substantially below atmospheric e.g. a vacuum of 15 to 18 inches mercury at cruising conditions.

When a vehicle driver removes his foot from the gas pedal, the throttle closes to the curb idle position and the manifold vacuum becomes much greater such as, for example, 25 inches of mercury. This sharply reduced absolute pressure causes at least a portion of a liquid fuel in the intake manifold to flash to the vapor stage. Since air flow has been sharply reduced to a curb idle quantity, and since idle fuel is still being supplied by the idle fuel passage of the carburetor, the "vaporized" fuel results in an excess amount of fuel being supplied the engine. Such an excess can be detrimental in the sense that emissions are increased during such a transient condition. Such increased emissions are primarily unburned hydrocarbons (HC) and carbon monoxide (CO). Oxides of nitrogen (NOX) probably are not affected.

Some emission control devices being considered for future automotive use require a constant air/fuel ratio delivered to the engine under all driving conditions. Rapid increases in intake manifold vacuum result in a temporarily rich air/fuel mixture due to the evaporation of fuel which has previously condensed on the walls of the manifold. It is desirable to lean this temporarily rich condition.

SUMMARY OF THE INVENTION

The present invention is directed to an air-bleed control to provide a maximum air flow to the idle fuel system of a carburetor for a limited period of time after a rapid deceleration of the engine and movement of the throttle to the curb idle position. The increased air flow leans the fuel from the idle system to compensate at least in part for the added fuel vapors from the walls of the manifold. Thus, a more nearly correct fuel/air ratio is obtained during the initial part of the deceleration until the added fuel vapors from the manifold have been depleted. After a few seconds, the excess fuel is boiled away and it is necessary to restore the normal idle fuel quantity.

The air bleed control means comprising the present invention is operatively connected to an air bleed valve member and has a body forming an air chamber and a vacuum chamber on opposite sides of a diaphragm. The vacuum chamber is in fluid communication with the intake manifold of the engine and a restricted opening of a predetermined size is provided between the vacuum chamber and the air chamber. An operating stem secured to the diaphragm is connected to the air bleed valve and moves the air bleed valve between open and closed positions. The diaphragm is responsive to the manifold vacuum and upon a rapid engine deceleration to idle position the diaphragm moves the air bleed valve in one direction to provide maximum air flow to the idle fuel system. When the pressure between the vacuum chamber and the air chamber is equalized upon the flow of air through the restricted opening between the air and vacuum chambers, the air bleed valve is moved in a direction to reduce the air flow to the idle fuel passage. Thus, the present invention is "self-timing" as the timing may be controlled by the volume of the "air chamber" in relation to the "vacuum chamber" and the size of the restricted opening between the air and vacuum chambers.

DESCRIPTION OF THE DRAWINGS

The invention for purposes of illustration and description is shown in the accompanying drawings, forming a part of the specification, wherein.

Figure 1:
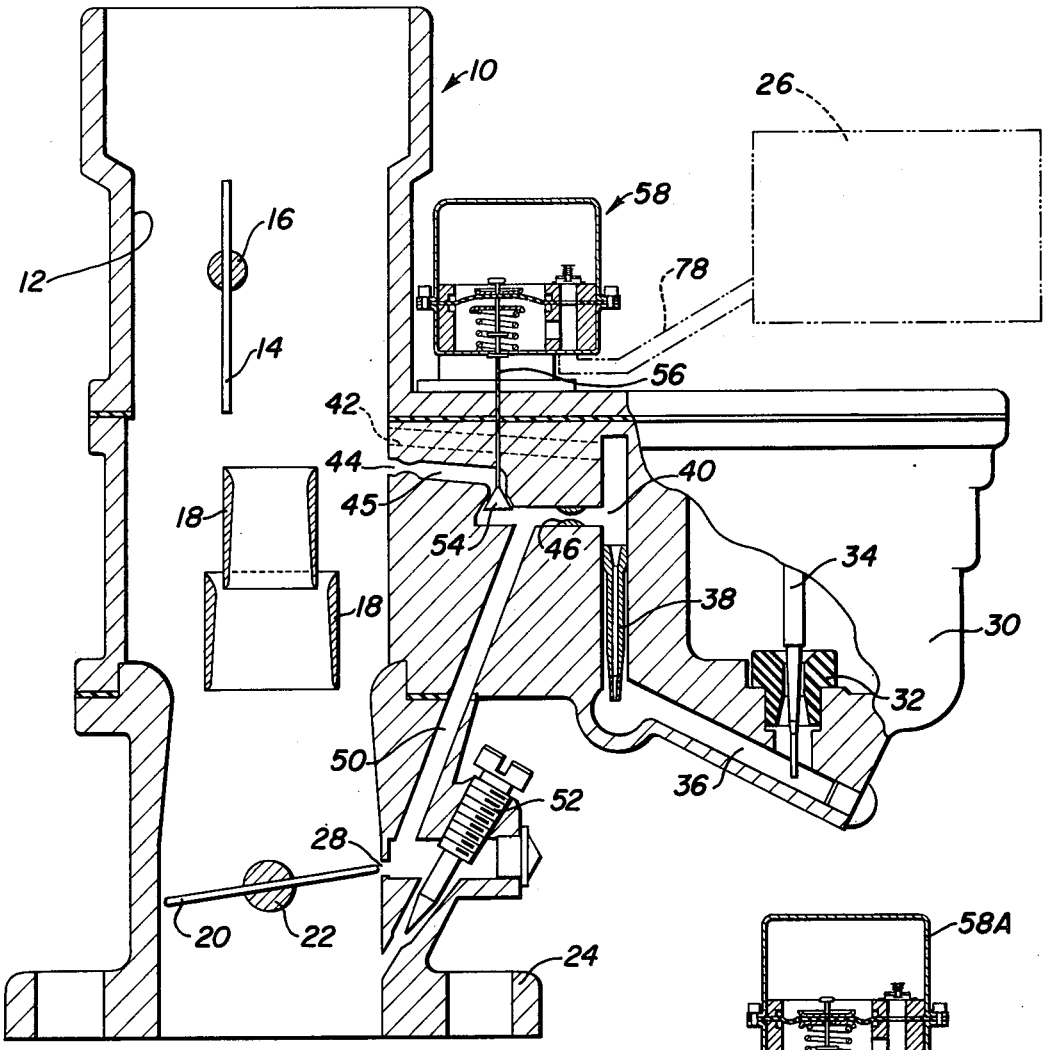
FIG. 1 is a vertical section, partly in schematic, of a carburetor having the air bleed control for the idle system which comprises the present invention mounted thereon.
Figure 5:
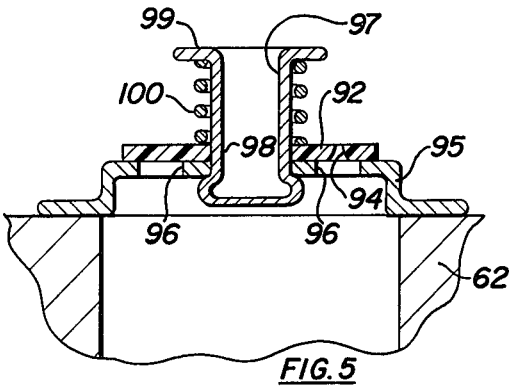
FIG. 5 is an enlarged section of the check valve between the air and vacuum chambers.

Referring now to the drawings, and more particularly to the embodiment shown in FIGS. 1–5, a carburetor is indicated generally at 10 and has an air and fuel mixture conduit or barrel 12. An air valve 14 is mounted within mixture conduit 12 about shaft 16 for movement between open and closed positions relative to conduit 12. A plurality of venturis 18 are mounted within air mixture conduit 12 and a throttle valve 20 is mounted beneath venturis 18 about a throttle shaft 22. Throttle valve 20 may be connected to a foot pedal by a suitable linkage (not shown) for movement. A flange 24 on a lower end of mixture conduit 12 is adapted to be mounted on the intake manifold of an internal combustion engine shown schematically at 26.

In the idle position throttle valve 20 is almost closed and an idle port 28 is provided in the wall of mixture conduit 12. A fuel bowl 30 has a metering jet 32 mounted therein and a metering rod 34 extends within metering jet 32 to control the flow of fuel to fuel passage 36. An idle jet 38 leads to upper fuel passage portion 40. A bypass port 42 in the wall of air/fuel mixture conduit 12 is in fluid communication with upper fuel passage portion 40. An idle bleed port 44 in the wall of mixture conduit 12 communicates with upper idle bleed passage 45. A restriction 46 is provided in upper fuel passage portion 40. Air and fuel is mixed in upper fuel passage portion 40 and restriction 46 further aids in the mixing of fuel and air which flow through restriction 46. A lower idle fuel passage 50 leads to idle port 28. An idle adjustment screw 52 may be suitably adjusted to control the flow of the fuel/air mixture into mixture conduit 12.

To control the flow of air through idle bleed port 44, upper air bleed passage 45 and idle passage 50, an idle bleed valve member 54 is positioned in upper air bleed passage 45 and has an operating stem 56 secured thereto. Air bleed valve control means to control the movement of valve member 54 is generally designated at 58 and includes a lower body member 60 and an upper body member 62 having a diaphragm 64 therebetween. A lower cup-shaped member 66 fits around lower body portion 60 and has an upper peripheral flange 68. An upper cup-shaped member 69 fits about upper body portion 62 and has a lower peripheral flange 70. Diaphragm 64 is clamped between body members 60, 62 and flanges 68, 70 by suitable securing elements 72. Upper cup-shaped member 69 forms an air chamber 74 and lower cap-shaped member 66 forms a vacuum chamber 76. A vacuum line 78 is connected to the intake manifold of the internal combustion engine indicated at 26. A vacuum passage 80 leads from line 78 to vacuum chamber 76. Operating stem 56 has a lower diaphragm plate 81 fixed thereto. An upper diaphragm plate 82 is secured to diaphragm 64 and is mounted for sliding movement on stem 56. Stem 56 has a head 84 to restrict upward movement of diaphragm 64 and lower plate 81 restricts downward movement of diaphragm 64. A spring 86 is compressed between lower cup-shaped member 66 and lower plate 81 to urge continuously diaphragm 64 in an upward direction as viewed in FIGS. 3 and 4. An upper stop 88 and a lower stop 90 are secured to operating stem 56 to restrict the movement of operating stem 56 in either direction of travel to prevent damage to diaphragm 64 which might result from overstressing of diaphragm 64.

To provide fluid communication between air chamber 74 and vacuum chamber 76, a one-check valve member 92 is provided between vacuum chamber 76 and air chamber 74 at the end of vacuum passage 80 and has a restricted opening 94 therein. A seat 95 is secured to upper body member 62 and has openings 96 therein. A spring retainer member 97 has a stem 98 secured to seat 95 and a head 99 on one end of stem 98. A spring 100 is biased between check valve member 92 and head 99 to urge continuously valve member 92 toward seated engagement on seat 95.

When check valve member 92 is seated on seat 95 and a pressure in vacuum chamber 76 exists which is lower than the pressure in air chamber 74, check valve member 92 will remain in seated position and air will flow from air chamber 74 to vacuum chamber 76 through opening 94 thereby to equalize the pressure between chambers 74 and 76. The time in which the pressure in vacuum chamber 76 may be equalized with the pressure in air chamber 74 upon a rapid engine deceleration may be determined or controlled by the volume of air chamber 74 in relation to the volume of vacuum chamber 76 and the size of opening 94 between air chamber 74 and vacuum chamber 76. When a pressure exits in air chamber 74 less than the pressure in vacuum chamber 76, valve member 92 will unseat and the pressure in chambers 74 and 76 will be rapidly equalized by the flow of air through openings 96.

OPERATION

During normal driving and relatively slow acceleration, fuel is supplied along with air to the manifold of the engine and some of the fuel wets the walls of the intake manifold. A vacuum of between 15 to 18 inches of mercury is exerted from the intake manifold and diaphragm 64 is generally in the position illustrated in FIGS. 1 and 2 with diaphragm 64 and plate 82 spaced from fixed diaphragm plate 81. Upon a rapid deceleration to an idle position the manifold vacuum may increase to a large amount such as 25 to 26 inches of mercury which will cause at least a portion of liquid fuel in the manifold to flash to a vapor stage. Thus, a rich mixture of air/fuel is supplied to the engine. Upon rapid deceleration to idle position, a large vacuum in vacuum chamber 76 moves diaphragm 64 and plate 82 in a downward direction to contact plate 81 and then operating stem 56 and valve member 54 move to the position shown in FIG. 4 to increase the flow of air into idle passage 50 and to lean the air/fuel mixture to idle port 28. After a few seconds the pressure in vacuum chamber 76 will be equalized with the pressure in air chamber 74 by the flow of air through opening 94 to vacuum chamber 76. When the pressure equalizes, diaphragm 64 moves upwardly and spring 86 urges plate 81 and stem 56 to the position of FIG. 2 in which stop 90 engages cup-shaped member 66 to limit the movement of valve member 54 and yet permit a limited flow of air to idle passage 50. However, by this time, the fuel which has flashed on the walls of the manifold has been used and there is no further requirements for additional air to be bled into the air/fuel mixture.

After the movement of stem 56 has been limited by stop 90, diaphragm 64 is free to move upwardly until head 84 is contacted by upper plate 82 which would probably occur upon a rapid acceleration and a pressure in vacuum chamber 76 which exceeded the pressure in air chamber 74. Unseating of check valve member 92 under such conditions would rapidly equalize the pressure in chambers 74 and 76. Diaphragm 64 upon equalizing the pressures in chambers 74 and 76 would probably return to the position shown in FIGS. 1 and 2.

Figure 6:
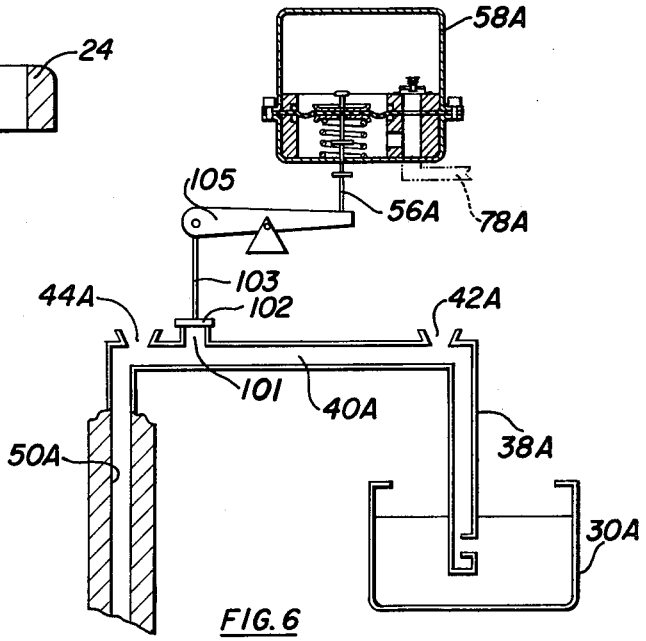
FIG. 6 is a schematic view of a separate embodiment in which an air bleed control is provided at a separate port for the idle fuel passage.
Figure 2:
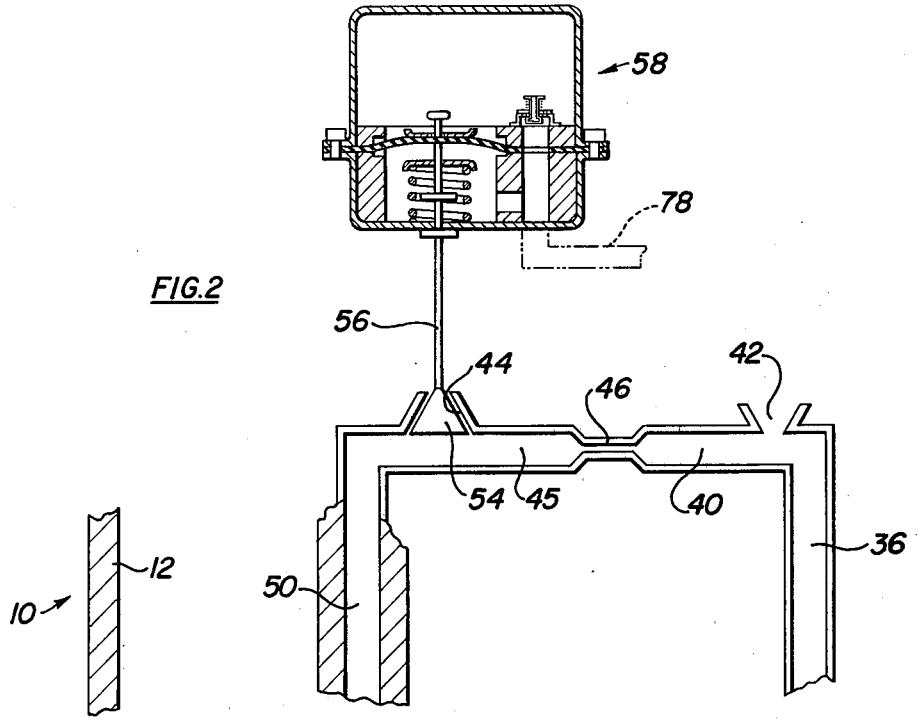
FIG. 2 is an enlarged primarily schematic view of the air bleed control shown in FIG. 1.
Figure 3:
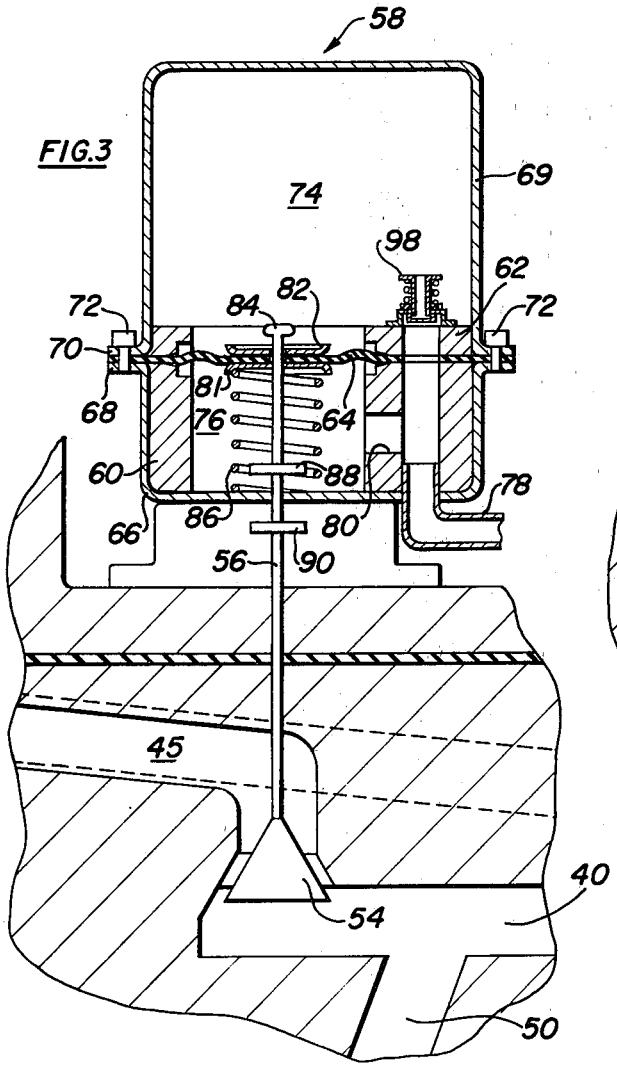
FIG. 3 is an enlarged vertical section, partly schematic, of the air bleed control illustrating the air and vacuum chambers with the diaphragm in an intermediate position.
Figure 4:
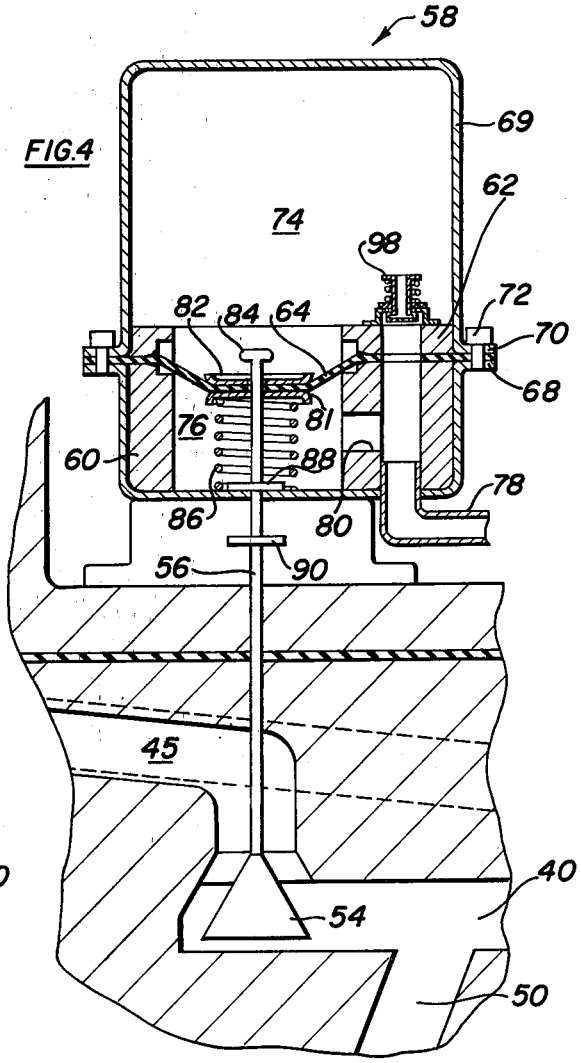
FIG. 4 is an enlarged section similar to FIG. 2 but illustrating the air bleed control in a maximum air flow condition obtained during rapid deceleration to idle position.

Referring to FIG. 6, a separate embodiment of the invention is illustrated schematically in which a separate bleed port 101 is provided and a valve member 102 is arranged for additional bleed port 101. A bypass port 42A and an idle bleed port 44A communicate with passage 40A. A rod 103 is operatively connected by a suitable lever arm 105 to operating stem 56A. Air bleed control 58A to control the movement of stem 56A and valve 102 is substantially identical to air bleed control 58 shown in the embodiment of FIGS. 1–5 and when a relatively high vacuum is provided from vacuum line 78A, a downward movement of operating stem 56A results in an upper movement of valve member 102 to permit additional air to be bled into air bleed passage 40A and idle passage 50A. A fuel bowl 30A and fuel passage 38A supply fuel to idle passage 50A.

What is claimed is:

1. In a carburetor for an internal combustion engine having a fuel bowl, an air and fuel mixture conduit, a throttle valve mounted within said conduit, an idle port in the mixture conduit adjacent the closed position of the throttle valve, an idle fuel passage between the idle port and the fuel bowl, an air bleed port in said carburetor in fluid communication with the idle fuel passage, and an air bleed valve member to control the amount of air flow through said air bleed port, the improvement of air bleed valve control means integral with said carburetor to control the movement of said valve member, said control means comprising a body having an air chamber therein, a diaphragm in said body having one side thereof facing the air chamber, a vacuum chamber adjacent the other side of said diaphragm in fluid communication with an intake manifold of the internal combustion engine, a check valve member between the vacuum chamber and the air chamber and having a restricted opening of a predetermined size to permit fluid communication between the vacuum and air chambers in a seated position of the check valve member, spring means urging the diaphragm in a direction toward the said air chamber, an operating stem operatively connected between the air bleed valve member and diaphragm and positioned within the vacuum chamber to move with the diaphragm, said diaphragm being responsive to manifold vacuum and upon rapid engine deceleration said diaphragm and operating stem in response to the relatively large pressure differential between the said vacuum chamber and the said air chamber to move said air bleed valve member in one direction to provide maximum air flow to said idle fuel passage, said pressure differential being reduced upon the flow of air through the restricted opening in said check valve member whereby after a predetermined time said air bleed valve member moves in an opposite direction to reduce the air flow to said idle fuel passage.

2. In a carburetor as set forth in claim 1 wherein said check valve member is unseated when the pressure in said vacuum chamber exceeds the pressure in said air chamber to permit a rapid equalization of pressure in the air and vacuum chambers.

3. In a carburetor as set forth in claim 2 wherein said check valve member is generally disc-shaped and has a restricted opening therethrough, and spring means urge the disc-shaped valve member toward a seated position in a direction toward the vacuum chamber.

* * * * *